United States Patent [19]

McDougal

[11] 4,240,256

[45] Dec. 23, 1980

[54] PHASE-ANGLE CONTROLLER FOR STIRLING ENGINES

[76] Inventor: Robert A. Frosch, Administrator of the National Aeronautics and Space Administration, with respect to an invention of Allan R. McDougal, La Crescenta, Calif.

[21] Appl. No.: 8,208

[22] Filed: Jan. 31, 1979

[51] Int. Cl.[3] ..... F02G 1/06

[52] U.S. Cl. ..... 60/518; 74/417

[58] Field of Search ..... 60/518; 74/417

[56] References Cited

U.S. PATENT DOCUMENTS

| | | |
|---|---|---|
| 2,465,139 | 3/1949 | Van Weenen . |
| 2,508,315 | 5/1950 | Van Weenen . |
| 3,315,465 | 4/1967 | Wallis . |
| 3,416,308 | 12/1968 | Livezey . |
| 3,482,457 | 12/1969 | Wallis . |
| 3,994,136 | 11/1976 | Polster . |
| 4,074,530 | 2/1968 | Polster . |

*Primary Examiner*—Allen M. Ostrager

*Attorney, Agent, or Firm*—Monte F. Mott; John R. Manning; Wilfred Grifka

[57] ABSTRACT

A first embodiment incorporating an actuator including a restraint link adapted to be connected with a pivotal carrier arm for a force transfer gear interposed between the crankshaft for an expander portion of a Stirling engine and a crankshaft for the displacer portion of the engine, said restraint link being releasably supported against axial displacement by releasably trapped hydraulic fluid for selectively establishing a phase angle relationship between the crankshaft and a second embodiment incorporating a hydraulic coupler for use in varying the phase angle of gear-coupled crankshafts for a Stirling engine whereby phase angle changes are obtainable.

19 Claims, 9 Drawing Figures

PHASE-ANGLE CONTROLLER FOR STIRLING ENGINES

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention

The invention generally relates to actuators used to control the phase relation between the expander and displacer portions of Stirling engines, and more particularly to a hydraulic actuator which takes advantage of variations in torque requirements for the displacer portion of a Stirling engine during each rotation thereof, whereby the phase relation between the expander and displacer is varied through use of minimal external force.

2. Description of the Prior Art

The name Stirling engine frequently is indescriminantly applied to various types of regenerative machines, including both rotary and reciprocating engines, utilizing mechanisms of varying complexity and covering machines capable of operating as prime movers, heat pumps, refrigeration engines and pressure generators. However, for the purpose of the invention as herein disclosed it is to be understood that a Stirling engine is a device particularly designed to operate on a closed regenerative thermal dynamic cycle and is characterized by a cyclic compression and expansion of a working fluid at different temperature levels with flow control for the fluid being established by volumetric changes so that a net conversion of heat to work or work to heat is realized.

While Stirling engines frequently are provided with two pistons connected to a common crankshaft and equipped with a heat exchanger connected between the pistons, it is known that a Stirling engine also can be so constructed as to employ two pistons connected to separate crankshafts. Hence, as herein employed the term expander portion of a Stirling engine refers to that portion of the engine having a crankshaft and within which hot gases are expanded for converting heat energy to work, while the term displacer portion of the engine refers to that portion of the engine having a crankshaft to which a piston is connected for utilizing power transmitted thereto from the expander portion to compress a cool working gas. It is to be understood that the displacer portion of the engine, herein referred to in operation, experiences torque requirements ranging between both positive and negative torque input during each cycle of operation, while the output of the expander portion simultaneously undergoes changes ranging between 0 and positive value. The phase positive and negative torque refers to force input during unidirectional rotation of the crankshafts.

The performance of a Stirling engine having dual crankshafts, or separate crankshafts for the expander and displacer portions, is dependent in large measure upon the phase relation established between the dual crankshafts, much in the same manner that the power of an automobile engine is dependent upon the timing of the ignition system. For example, where the phase angle between the crankshafts is zero there is little or no power output, where the phase angle is approximately positive 90° the power output is maximum in a "forward" rotation; and where the phase angle is approximately negative 90° the power output is a maximum in a "reverse rotation".

It is, of course, known that the phase relation control between dual crankshafts can be achieved through the use of a force transfer gear meshed with a pair of coaxially spaced bevel gears, separately mounted on the crankshafts, and supported by a carrier arm for planetary travel relative to the bevel gears. For example, see U.S. Pat. No. 3,315,465.

During the course of a search conducted on the invention herein described and claimed, the following additional U.S. Pat. Nos. were discovered:

3,482,457 which relates to hydraulically actuated, differential geared Stirling engine phase changers;

3,315,465, 3,416,307, and 3,416,308 which relate to low torque Stirling engine phase changers with differential gears; and 2,465,139, 2,508,315, 3,994,136 and 4,074,530 which relate to other mechanical Stirling engine phase changers.

Of course, phase changes between the expander and displacer portions of a Stirling engine usually require application of substantial torque. The amount of torque normally required is greater than which can conveniently be derived from a simple hand lever. Consequently, because of the large amounts of force required in achieving a phase-change relation between the expander and displacer portions of a Stirling engine, there currently exists a need for a simple device through which an operator may readily adjust the speed/power for such an engine, without requiring that the operator manually apply large amounts of force, regardless of whether the engine is operating or is quiescent.

It is therefore the general purpose of the instant invention to provide phase-angle control means coupled with the crankshafts of a Stirling engine and adapted to be used in establishing variable phase-angle relationships between the crankshafts utilizing variations in torque requirements of the displacer portion of the engine during each rotation of the crankshafts, without sacrificing the utility of the engine or power outputs thereof.

OBJECTS AND SUMMARY OF THE INVENTION

It is an object of the instant invention to provide an improved phase-angle control mechanism for a Stirling engine.

It is another object to provide in combination with a Stirling engine characterized by a pair of coaxially aligned bevel gears mounted on dual crankshafts and a bevel gear mounted on a carrier arm and meshed with the aligned pair comprising a force transfer gear supported to be advanced along a planetary path for varying the phase angle therebetween, an actuator, including an axially displaceable link connected with the carrier arm, having a capability of functioning as a hydraulic ratchet for restraining the link against axial displacement in response to changing torque conditions within the transmission.

It is another object to provide in a Stirling engine an actuator for a phase-angle controller characterized by an hydraulic coupler for use in interconnecting the crankshafts of the engine in a variable phase-angle relationship.

These and other objects and advantages are achieved through the use of a hydraulic actuator adapted to employ variations in torque requirements for the displacer portion of a Stirling engine, during each rotation of its crankshaft, whereby minimal external forces are required for varying phase relations between the expander and displacer portions of the engine, as will hereinafter become more readily apparent by reference to the following description and claims in light of the accompanying drawings.

DESCRIPTION OF THE PREFERRED EMBODIMENT

Figure 1:
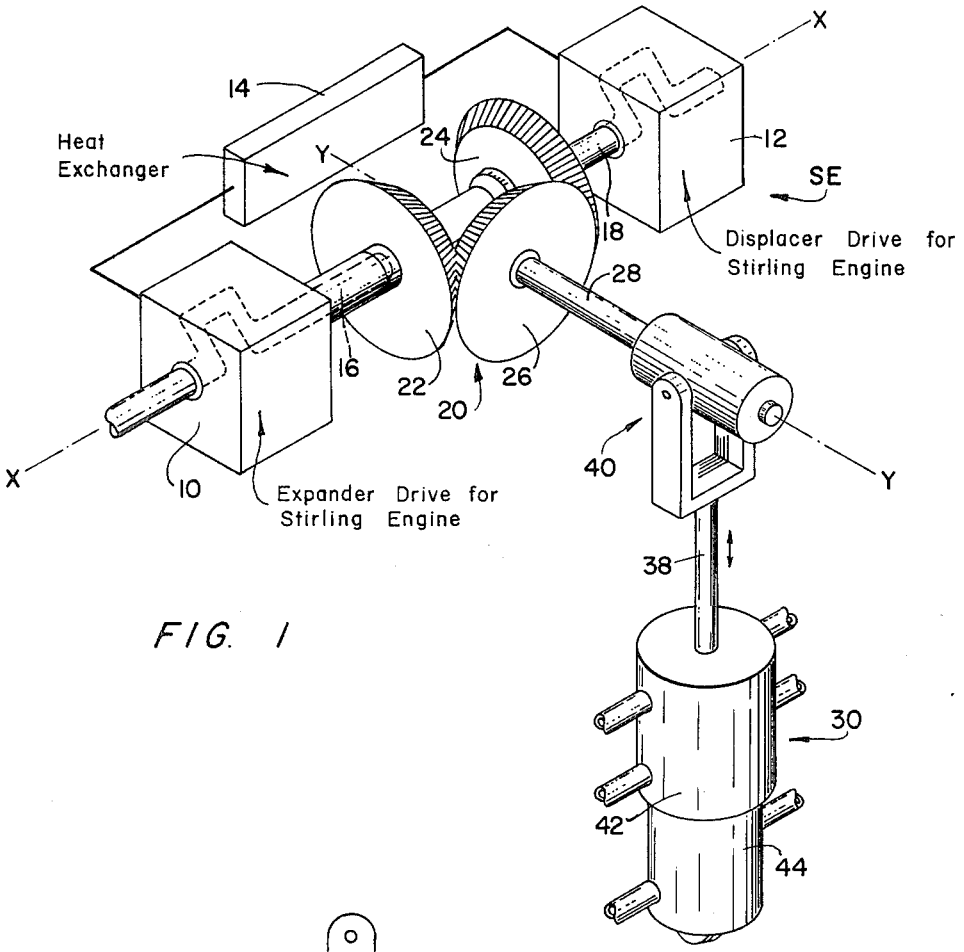
FIG. 1 is a perspective, partially schematic view, depicting a first embodiment of the instant invention.

Referring now to the drawings, with more particularity, wherein like reference characters designate like or corresponding parts throughout the several views there is schematically shown in FIG. 1 a Stirling engine, generally designated SE of known design.

Since the Stirling engine SE is of known design, a detailed description thereof is omitted in the interest of brevity. However, it is to be understood that the engine SE includes an expander portion 10, a displacer portion 12 and an inter related heat exchanger, designated 14. The expander portion 10, as shown, includes a crankshaft, indicated by the reference numeral 16, while the displacer portion 12 includes a crankshaft indicated by the reference numeral 18. It will be appreciated that the crankshafts 16 and 18 are independently supported for mutually independent rotation. It is to be understood, further, that the crankshaft 16, in effect, comprises a power output shaft for the expander portion 10, of the engine SE, while the crankshaft 18 comprises a power input shaft for the displacer portion 12 of the engine and that the phase-angle between these shafts determine the power output capabilities of the engine.

As illustrated in FIG. 1, the engine SE includes a transmission which, as a practical matter, serves as a phase-angle controller for the engine, generally designated 20. It is noted that the transmission, or controller, includes a first bevel gear 22 rigidly mounted on the crankshaft 16 and a bevel gear 24 rigidly mounted on the crankshaft 18. The bevel gears 22 and 24 comprise mirror images, each of the other, and are arranged in coaxial alignment for receiving in meshed relation a bevel gear comprising a force transfer gear 26 having a number of teeth equal to the number of the teeth of gears 22 and 24.

The force transfer gear 26 is similar in design and configuration to the bevel gears 22 and 24 and serves to transfer torque between the bevel gears 22 and 24. In practice, the gears 22 and 24 are supported for rotation about an axis, designated x—x, while the force transfer gear 26 is supported for rotation about an axis designated y—y, normally related to the axis x—x.

Figure 5:
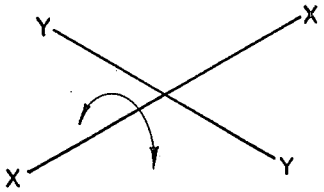
FIG. 5 is a diagrammatic view further illustrating a function of the actuator.

As shown, the force transfer gear 26 is mounted on a carrier arm 28 and is supported thereby for planetary travel, relative to the bevel gears 22 and 24, along an arcuate path concentrically related to the axis x—x. While not shown, it also is to be understood that suitable means are provided for supporting the carrier arm 28 at its base end, for rotation about an axis coincident with the axis x—x, as indicated in FIG. 5. Since such carrier arms are known, a detailed discussion of the mounting therefor is omitted.

Figure 3:
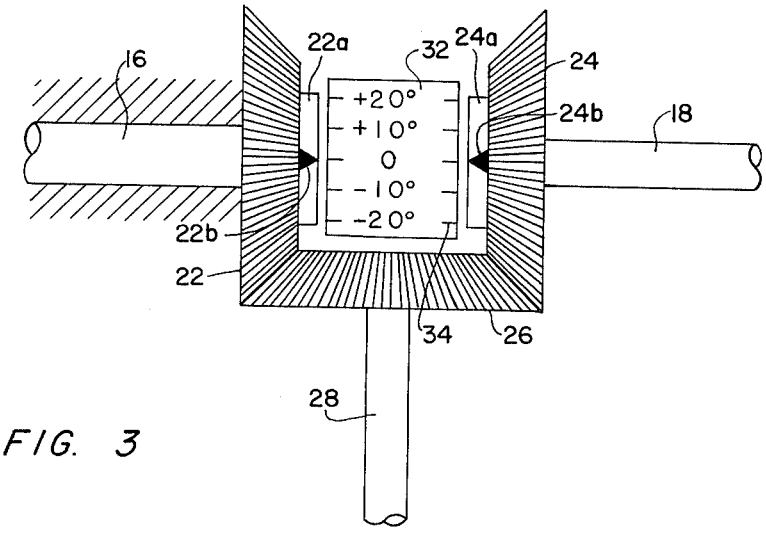
FIGS. 3 and 4 comprise schematic views, not to scale, which collectively illustrate sequential positions assumed by a force transfer gear for achieving a phase change in response to operation of the actuator shown in FIGS. 1 and 2.
Figure 4:
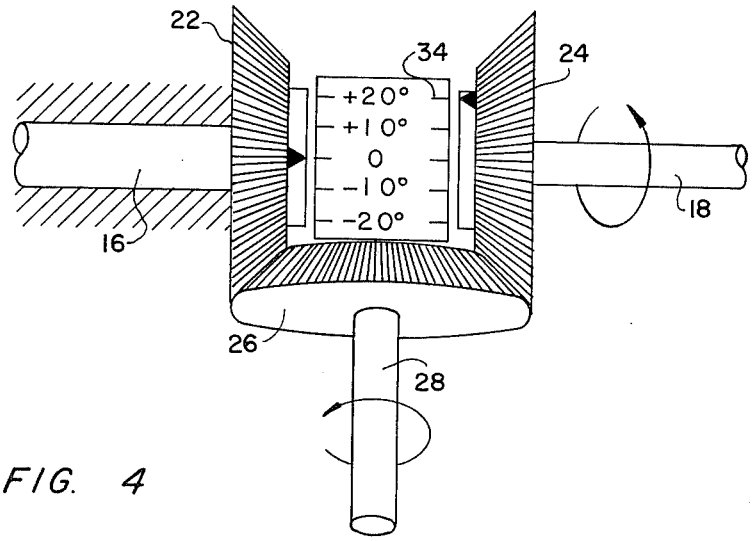

As should now be apparent, the phase relation of the expander portion to the displacer portion may be varied simply by varying the position of the gear 26 relative to the gears 22 and 24, as collectively illustrated in FIGS. 3 and 4. To illustrate, it can be assumed that attached to the bevel gears 22 and 24 are narrow circular drums **22*a* and 24*a*, respectively, on which are mounted pointers 22*b* and 24*b*. Between the drums 22*a* and 24*a* there is positioned a scale 32 bearing gradation 34 incrementally graduated from positive 20° to a negative 20°, for indicating the instantaneous phase-angle relation between the crankshafts 16 and 18**.

The two shafts of the engine SE are synchronized, when the phase-angle therebetween is 0° and exists when a neutral phase-angle position is effected. To establish a neutral phase-angle the beveled gears are manually rotated until the indicators **22*b* and 24*b* are aligned at opposite sides of the "zero" mark on the scale 32. The force transfer gear 26 is now meshed with the gears 22 and 24**.

The manner in which the phase is shifted between the shafts 16 and 18 can readily be appreciated when it is visualized that if the gear 22 is held stationary while the gear 24 remains free to rotate, and the carrier arm 28 is elevated in a manner such that counterclockwise rotation is imparted to the force transfer gear 26 mounted thereon, as indicated in FIG. 4, the indicator **22*b* will continue to be aligned with the gradation mark designated zero, while the indicator 24*b* will align itself with another gradation mark as the gear 24 responsively is rotated. Counterclockwise rotation of the force transfer gear 26 is effected simply by causing the carrier arm 28 to pivot in a manner such that the arm elevates from the plane of the drawings, while a clockwise rotation of the gear 26 is achieved in response to depressing the carrier arm. Since the gear 24 remains free to rotate, rotation of the gear 26 serves to rotate the gear 24. Thus a phase shift readily is achieved. It also should be apparent that a moment for producing pivotal motion for the arm 28 occurs as the gears 22 and/or 24** are driven in rotation in response to torque applied through the shafts thereof.

Figure 6:
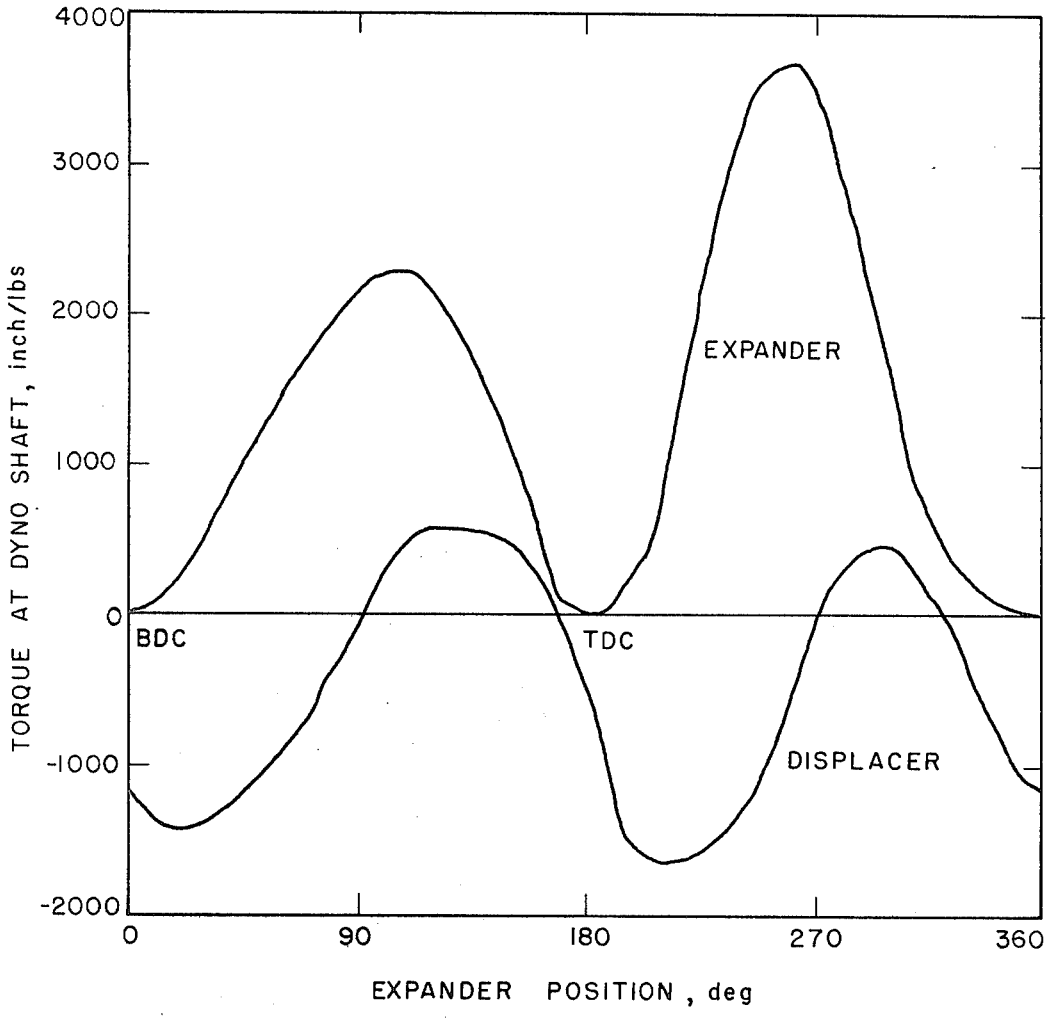
FIG. 6 comprises a graphic view depicting torque conditions normally encountered in an operation of the engine shown in FIG. 1.

FIG. 6 graphically illustrates torque values for expander and displacer portions of a Stirling engine during one complete cycle of operation. It is important to note that the instantaneous values of torque of the expander portion vary from 0 to a positive 3,500 inch pounds while the torque for the displacer portion 12 varies from a negative 16,000 to a positive 500 inch pounds. Hence, the gear 26 is subjected to negative torque as well as positive torque during each cycle of operation. That is to say, assuming that the gear 22 is driven, in response to torque applied through the shaft 16 of the expander, in a clockwise direction the gear 26 will be driven in a counterclockwise direction under a load determined by the loading of the shaft 18 for the displacer. Should the shaft 18 be restrained under its loading, a positive torque requirement exists and the gear 26 is positively loaded. However, should the gear 24 be driven in a counterclockwise direction in response to torque applied thereto through the shaft 18, the gear 26 will be negatively loaded, or attempt to over-run the gear 22. When the force transfer gear 26 is subjected to a positive torque condition, a negative or a downward movement is seen by the arm 28 and the pivotal motion of the carrier arm 28 is downwardly. Conversely, when a negative torque condition exists for the force transfer gear 26 a positive moment is seen by the arm 28 and the carrier arm is pivotally elevated.

In order to control pivotal displacement of the carrier arm 28, as well as to secure the arm against pivotal displacement, there is provided an actuator, generally designated 30, which comprises one embodiment of the instant invention. The actuator 30 simply permits the carrier arm 28 to seat at a desired position such that the beveled gear 24 is supported at an angularly advanced or retarded position, relative to the beveled gear 22. In other words, the actuator 30 functions in a manner similar to a hydraulic ratchet for permitting the carrier arm 28 to seek a selected new position in response to constantly changing torque requirements of the displacer portion 12 for the engine SE.

The actuator 30 includes a segmented housing 36, of substantially unitary construction, from which is projected the distal end portion not designated of an axially reciprocable restraint link 38. It is to be noted that the link 38 is of a length substantially greater than the length of the overall length of the housing 36. The extended or distal end portion of the link 38 is connected with the carrier arm 28 through a suitable coupling, generally designated 40. It is to be understood that while the coupling 40 is illustrated as a trunion, the coupling is of any suitable design and may be varied as desired. The purpose of the coupling 40 simply is to pivotally connect the link 38 of the actuator 30 with the carrier arm 28.

The housing 36 for the actuator 30 includes a first segment 42 and a second segment 44 coaxially aligned with the first. For the moment, attention is invited to the first segment 42 which preferably is of a cylindrical configuration and is closed at its ends, by annular wall members, designated 46 and 48, respectively, collectively defining a first pressure chamber 49, through which extends the link 38. The wall members 46 and 48 include coaxially aligned, cylindrical bores, not designated, through which are extended opposite end portions of the restraint link 38. Preferably, O-rings 50, or the like, are provided whthin the bores for maintaining a seal about the link 38 in a manner well understood by those familiar with such devices.

Figure 2:
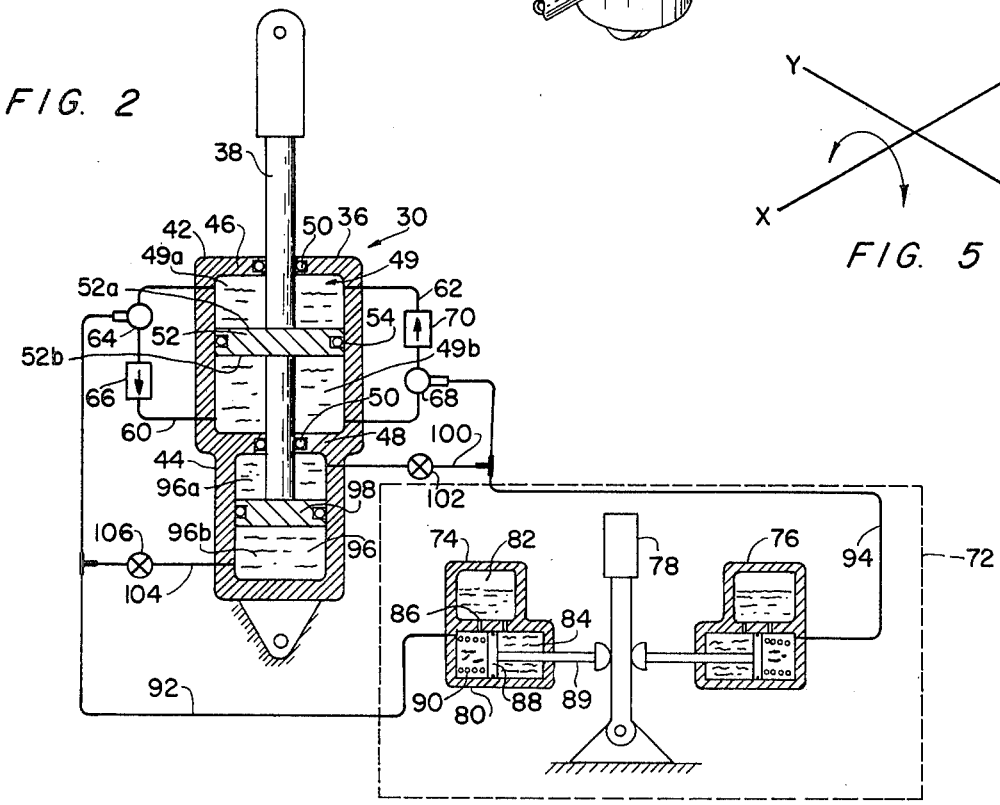
FIG. 2 is a substantially vertically sectioned view of the actuator illustrating a control circuit therefor.

As best illustrated in FIG. 2, the link 38 is provided with a first piston head 52 seated in the pressure chamber 49 and having commonly configured, oppositely directed pressure faces 52*a* and 52*b*. The piston head 52 includes a seal 54 circumscribing the peripheral surface thereof whereby the chamber 49 is divided into a first pair of pressure chambers, designated 49*a* and 49*b*. Each of these chambers is substantially completely filled with a hydraulic fluid such as oil or the like. It will, of course, be appreciated that so long as hydraulic fluid remains trapped in the chambers 49*a* and 49*b* the piston head 52 remains substantially stationary. Of course, as reactive forces resulting from changing torque conditions for the controller 20 are applied to the carrier 28 a pressure differential will develop across the head 52. For example, in the event reactive forces tend to force the carrier arm 28 to pivot downwardly, as illustrated in FIG. 1, pressure within chamber 49*b* tends to build. Conversely, in the event reactive forces applied to the arm 28 are applied in a direction for pivoting the arm upwardly, pressure within the chamber 49*a* is increased. However, unless displacement of the hydraulic fluid contained within the chambers 49*a* and 49*b* is accommodated the link 38 remains in a static operative state.

With reference to FIG. 2, it can be seen that there is provided an hydraulic circuit, generally designated 58, through which the chambers 49*a* and 49*b* communicate through first and second conduits 60 and 62, respectively. As shown, within the conduit 60 there is connected, in series, a pilot valve 64 and a check valve 66, while within the conduit 62 there is similarly connected a pilot valve 68 and a check valve 70. It is noted that the pilot valves 64 and 68 are of any suitable design which permit the valves to open and close the conduits within which they are connected. A fluid driven spool valve functions quite satisfactorily for this purpose. The check valves 66 and 70 comprise one way check valves, of conventional design, so arranged within the conduits 60 and 62, respectively, that a fluid flow from chamber 49*a* to chamber 49*b* is accommodated via the conduit 60, only, and fluid flow from the chamber 49*b* to the chamber 49*a* is accommodated via the conduit 62, only. Hence, in order for the link 38 to be extended it is necessary for the pilot valve 64 to be opened for thus permitting hydraulic fluid to pass from the chamber 49*a* to the chamber 49b, I via the conduit 60. Similarly, in order for the link 38 to be retracted the valve 68 must be opened for thus permitting hydraulic fluid to pass from the chamber 49b to the chamber 49a, via the conduit 62.

In order to control the opening and closing of the valves 64 and 68 for thus controlling the direction of flow through the conduits 60 and 62, the pilot valves 64 and 68 are connected with a master control system, designated 72. The master control system 72, as shown, includes a first master control cylinder 74 and a second master control cylinder 76 disposed in juxtaposed relation, at opposite sides of a manually operable control lever 78. This lever normally assumes a vertical position comprising a neutral operative position for the system 72. Each of the cylinders 74 and 76 include an actuator shaft projected into engaged relation with the lever 78, at the opposite sides thereof.

It is to be understood that the master control cylinders 74 and 76 are of common design and operate in a similar manner in order to perform a similar function. Therefore, a detailed description of the master control cylinder designated 74 is believed adequate to provide for a complete understanding of the instant invention.

The master control cylinder 74, as best shown in FIG. 2, comprises a housing 80 including a first chamber 82 the purpose of which is to serve continuously as a source of fluid, such as oil or the like. Arranged immediately beneath the chamber 82 is a pressure chamber 84. The chambers 82 and 84, in turn, communicate through mutually spaced ports 86, whereby passage of hydraulic fluid between the chambers is facilitated.

Within the chamber 84 there is disposed an actuator comprising a spring-loaded piston 88 having a shaft 89 projected axially through a bore, not designated, formed in the wall of the chamber 84. As a practical matter, the piston shafts 89 function as actuator shafts for the master control cylinders 74 and 76. While not shown, it is to be understood that the shaft is sealed with respect to the bore through a use of O-ring seals or the like. The piston 88 preferably is continuously urged in extension from the chamber 84 by a helical compression spring 90 seated therewithin. The chamber 82, on the other hand, is so positioned as to serve as a reservoir for supplying gravitating hydraulic fluid to opposite ends of the chamber 84, via the ports 86.

The chamber 84 is connected in communication with the pilot valve 64 via a conduit 92 so that axial displacement of the piston 88, against the applied forces of the spring 90 serves to apply fluid pressures to the pilot valve 64 for actuating the valve causing it to assume an open condition. The pilot valve 64 thus is caused to open for establishing communication between the chambers **49*a* and 49*b* via the conduit 60**.

In a manner similar to that hereinbefore discussed, the master control cylinder 76 is connected with the pilot valve 68, via a conduit 94, for purposes of controlling fluid flow through that pilot valve. Hence, it should now be apparent that when the control lever 78 is disposed in its neutral position, both of the pilot valves 64 and 68 remain closed. However, by pivotally displacing the lever 78 in a first direction the pilot valve 64 is opened, while the valve 68 remain closed. A reversed pivotal displacement of the phase control lever 78 serves to initiate an opening of the valve 68, in a manner similar to that in which the valve 64 is opened, while the valve 64 remains closed. Due to the effects of the helical springs acting on the pistons 88, the shafts 89 thereof tend to follow the lever 78 as it is pivotally displaced in opposite directions whereby a substantial balancing of forces between the applied forces of the shafts acting on the control lever 78 is facilitated.

In view of the foregoing, it is believed to be apparent that in order to permit the restraint link 38 to be elevated, as shown in the drawings, under the influence of the reactive forces applied to the carrier arm 28, the phase control lever 78 is pivoted in a direction such that hydraulic fluid pressure is applied to the pilot valve 64, via the conduit 92, for opening the pilot valve. Upon an opening of the pilot valve, hydraulic fluid is permitted to escape from the chamber **49*a* and pass through the check valve 66 to the chamber 49*b*. In order to permit the restraint link 38 to be depressed, displacement of the phase control lever 78 is initiated for applying hydraulic fluid pressure to the pilot valve 68, whereupon the valve 68 is opened and fluid is permitted to flow from the chamber 49*b*, via the conduit 62, to the chamber 49*a*. Once the force transfer gear is advanced, or retarded, as desired, the lever 78 is returned to its neutral position for thus causing both pilot valves to close for securing the link from any further linear motion. Thus the actuator 30 is caused to function as a hydraulic ratchet in response to the reactive forces applied to the carrier arm 28 as changing torque conditions occur within the transmission 20**.

In some instances it becomes desirable to vary the phase-angle relationship between the crankshafts 16 and 18 while the engine is in its quiescent or inactive state. In order to accommodate a change of phase-angle when the engine is quiescent, the segment 44 of the housing 36 is provided with an internal chamber 96 within which is seated a second piston head 98. This head also is affixed to the link 38 and serves to divide the chamber 96 into a pair of coaxially aligned pressure chambers **96*a* and 96*b*, similar in many respects to the chambers 49*a* and 49*b* and, like the chambers 49*a* and 49*b*, the pressure chambers 96*a* and 96*b*** are substantially filled with hydraulic fluid, not designated.

As shown, the chamber **96*a* is connected with the conduit 94 via a conduit 100 having connected therein a restrictor 102. Similarly, the chamber 96*b* is connected with the conduit 92, via a conduit 104 having connected therein a restrictor 106. Preferably, the conduits 100 and 104 are connected with the conduits 92 and 94 at suitable "T" fittings, not designated, while the restrictors 102 and 106** are so designed as to permit a restricted flow of fluid thereto at all times.

It can now be seen that the phase control lever 78 is adapted to be employed for achieving a phase change, even when the engine is in an inoperative state. For example, when the lever is pivotally displaced in a direction for increasing the pressure in the conduit 92 in order to open the valve 64, preparatory to permitting fluid pressure to be relieved in the chamber **49*a*, a flow of hydraulic fluid simultaneously is established from the conduit 92 through the restrictor 106 to the chamber 96*b* whereupon the pressure within the chamber 96*b* is increased for causing the link 38 to undergo axial extension. Of course, as the link 38 is extended hydraulic fluid is permitted to flow from the chamber 96*a* through the conduit 100 to the master control cylinder 94. As should be apparent, the phase control lever also is adapted to be pivoted in an opposite direction, for opening the valve 68, and for causing a reversed pressure condition to be established for the chambers 96*a* through 96*b* for causing the link 38** to be retracted.

FURTHER PREFERRED EMBODIMENT

Figure 7:
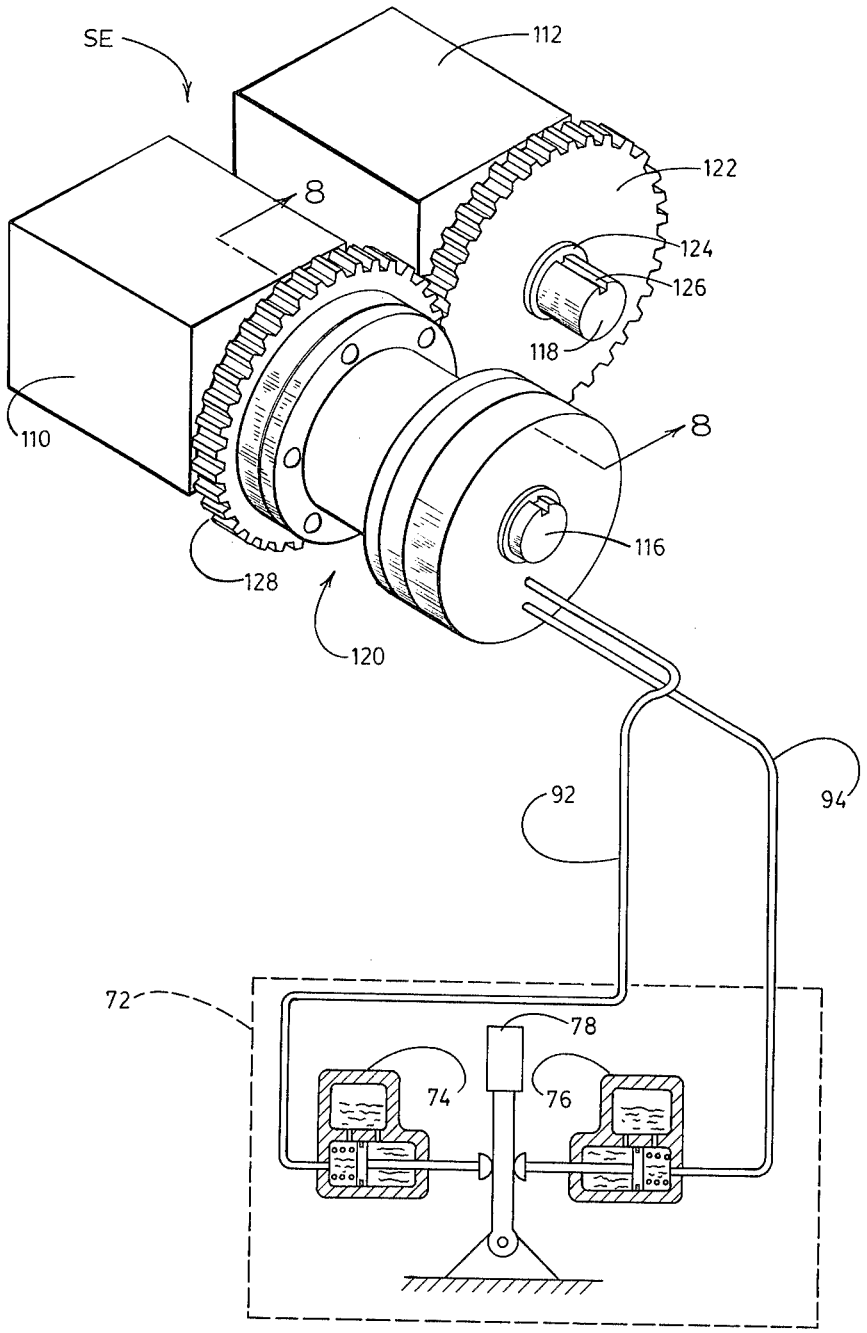
FIG. 7 is a perspective, partially schematic view depicting a further embodiment of the invention.
Figure 8:
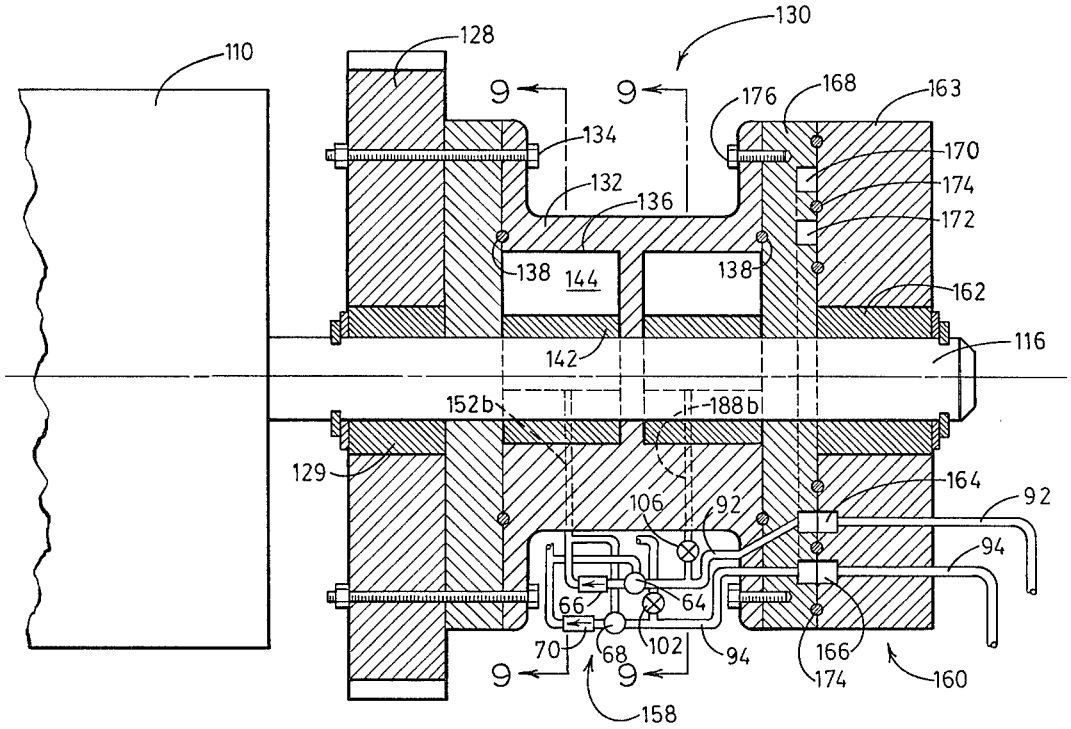
FIG. 8 is a sectional view taken generally along line 8—8 of FIG. 7.
Figure 9:
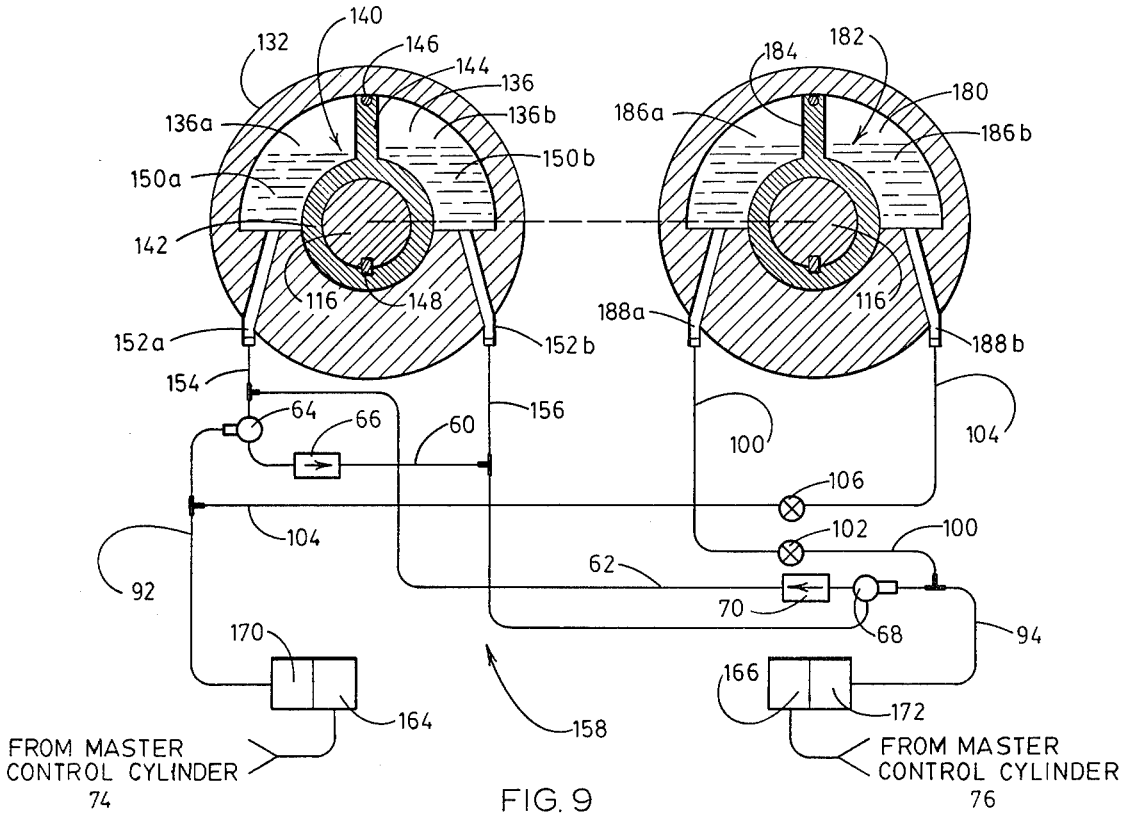
FIG. 9 is a schematic view of the further embodiment.

Attention is now kindly invited to FIGS. 7, 8 and 9 wherein is depicted a further preferred embodiment of the instant invention.

It is to be understood that component parts of the further preferred embodiment, hereinafter to be described, which correspond to component parts of the embodiment of the invention previously described are similarly numbered.

With particular reference to FIG. 7, therein is illustrated an expander portion 110 for a Stirling engine SE and a displacer portion 112 for the Stirling engine. While not shown, it is to be understood that the expander and displacer portions of the engine are interconnected through a heat exchanger, similar in design and function to the heat exchanger 14, previously mentioned.

Additionally, it is important to note that the expander portion 110 is provided with a crankshaft 116, while the expander portion 112 is provided with a crankshaft 118. The crankshafts 116 and 118 are extended in mutual parallelism and are independently supported for mutually independent rotation. The crankshaft 116 serves as a power output shaft for the expander portion 110 of the Stirling engine while the crankshaft 118 comprises a power input shaft for the displacer portion 112 of the engine. The crankshafts 116 and 118 are interconnected through a phase-angle controller for the Stirling engine, generally designated 120.

The controller 120 includes a first spur gear 122 mounted on the shaft 118 in fixed relation therewith. As a practical matter, a retainer 124 of a suitable design is provided for securing the spur gear 122 against axial displacement, while a coupling including a key seated key-way 126 is provided for securing the gear 122 against rotation relative to the shaft 118.

Meshed with the gear 122 is a spur gear 128 mounted on and supported for free rotation relative to the shaft 116 by suitable bearings 129, FIG. 8. It will, therefore, be appreciated that the spur gear 128 is free to rotate relative to the shaft 116 while the spur gear 122 meshed therewith is rigidly affixed to the shaft 118.

In order to effect a change in the phase-angle relationship established between the shafts 116 and 118, the controller 120 is provided with an actuator, generally designated 130, FIG. 8. The actuator 130 includes a housing 132 of a substantially cylindrical configuration mounted on one face of the spur gear 128 and extended coaxially therefrom. In practice, suitable fasteners such as screws 134 are provided for rigidly securing the housing 132 to the face of the spur gear 128. Consequently, it should now be apparent that the housing 132 is supported by and rotates with the spur gear 128.

Within the housing 132 there is defined a first chamber 136, FIG. 9, arranged in concentric, juxtaposed relation with the shaft 116. The particular manner in which the chamber is fabricated is deemed a matter of convenience well within the purview of the art. Therefore, a detailed description of the manufacturing techniques employed in fabricating the chamber is omitted.

In any event, it is to be understood that the chamber 136 is sealed through the use of suitable O-ring seals 138 and the like. Also mounted on the shaft 116 is a vane assembly, generally designated 140, FIG. 9, including a collar 142 from which radially is projected a vane 144 of a substantially planar configuration. In practice, the vane 144 divides the chamber 136 into a pair of chambers designated **136*a* and 136*b*, each being isolated from the other through the use of a suitable seal 146 interposed between the extended edge portion of the vane 144 and the adjacent surface of the housing 132. As a practical matter, a key and key-way coupling 148 subassembly is provided for coupling the vane assembly 140 to the shaft 116**.

It should now be apparent that since the spur gear 128 is free to rotate relative to the crankshaft 116 and the housing 132 is mounted on the spur gear 128, while the vane assembly 140 is rigidly affixed to the shaft 116, relative angular displacement of the vane 144 within the chamber 136 must be accommodated in order to facilitate rotation of the spur gear relative to the shaft. Therefore, it should also be apparent that the housing 132 is coupled to the shaft 116 in instances where displacement of the vane relative to the chamber 136 is precluded. Hence, in order to couple the vane 144 to the housing 132 chambers **136*a* and 136*b* are filled with trapped bodies of hydraulic fluid designated 150*a* and 150*b* introduced therein and discharged therefrom through a pair of bores 152*a* and 152*b*, FIG. 9. These bores are drilled or otherwise formed in the wall of the housing 132 and serve to establish a flow path for the fluid forming the bodies of fluid 150*a* and 150*b***.

Connected to the bore **150*a* at its outermost extremity is a conduit 154, FIG. 9, while a conduit 156 is connected to the outermost extremity of the bore 152*b*. The conduits 154 and 156, in turn, serve to connect the subchambers 136*a* and 136*b* in mutual communication through a hydraulic circuit 158, similar in design and function to the hydraulic circuit 58**, previously described.

However, it is here important to note that a substantial portion of the circuit 158 is mounted on the external surface of the housing 132 and must, therefore, rotate with the housing as the housing is caused to rotate with the spur gear 128. Consequently, there is included within the actuator 130 an hydraulic coupling which serves to deliver fluid to that portion of the circuit mounted to rotate. This coupling includes a slip ring 160 mounted on the distal end of the shaft 116 and supported thereby through a use of a suitable bearing 162, FIG. 8. The bearing 162, as a practical matter, serves to accommodate rotation of the shaft 116, relative to the slip ring 160, which is supported in a stationary disposition through a use of a suitable mount, not shown. The slip ring 160, as shown, includes a base plate 163 having defined therein a first chamber 164 to which is connected conduit 154, of the circuit 158, and a second chamber 166 to which is connected conduit 156 of the circuit. The conduits 154 and 156 are similar in design and function to conduits 92 and 94 previously described.

It is also important to note that the slip ring 160 includes a coupling plate 168 rigidly connected to the housing 132 and seated in mated relation with the base plate 163. The coupling plate 168 is provided with a pair of concentrically related grooves, designated 170 and 172, of annular configurations disposed in direct communication with the chambers 164 and 166. These grooves, in effect, function as hydraulic manifolds. Hence, it will be appreciated that the grooves 170 and 172 are continuously charged with hydraulic fluid delivered to the chambers 164 and 166 via the conduits 92 and 94, respectively.

Of course, it should be understood that the mated surfaces of the plates 163 and 168 are suitably polished for establishing bearing seals which accommodate angular displacement of the plate 168, relative to the plate 163, while an hydraulic seal is maintained therebetween. Where so desired, seals 174 formed of suitable durable materials are employed for assuring a leak-proof fit is established between the faces of the plates 162 and 168 of the slip ring 60. Of course, the configuration and materials of the seals 174 may be varied without departing from the scope of the invention. Further, it will be appreciated that the coupling plate 168 is connected to the housing 132 employing suitable fasteners, such as screws 176 seated in internally threaded blind bores, not designated.

It should, at this juncture, be appreciated that the hydraulic manifolds formed by the grooves 170 and 172 are, in effect, interposed in the conduits 154 and 156 which serve in a similar capacity to the conduits 92 and 94 previously disclosed. Moreover, the conduit 154 serves to connect the bore **152*a* with a valve 64, at its input side, as well as to a conduit 62 located downstream of a check valve 70. Similarly, a conduit 156 is provided for connecting the bore 152*b* with the inlet side of a valve 68 as well as to connect the bore 152*b* with the downstream side of a check valve 66, via a conduit 60. Again, the valves 64 and 68, conduits 62 and 60 and check valves 70 and 66** function in a similar manner and for a purpose similar to that previously described to the similarly numbered component. Hence, a reiteration of the functions and purposes of these components is omitted.

It should now be apparent that simply by manipulating the phase control lever 78 in an appropriate direction, as hereinbefore described, the valve 64 is opened for permitting the body of fluid 150*a* to flow from subchamber 136*a* to subchamber 136*b* along a path extending through the bore 152*a*, the conduit 154, the valve 64, the check valve 66 and thence through the conduit 156 to the subchamber 150*b* via the bore 152*b*.

Similarly, a reverse manipulation of the phase control lever 78 serves to manipulate the valve 68 for permitting the body of fluid 150*b* to escape from the subchamber 136*b* along a path extended from that chamber to the subchamber 136*a* via the bore 152*b*, the conduit 156, the valve 68, the check valve 70, the conduits 62 and 154 and the bore 152*a*.

It should now be apparent that through simple manipulation of the phase control lever 78 an exchange of fluid between the bodies of fluid 150*a* and 150*b*, disposed in subchambers 136*a* and 136*b*, is effected. Consequently, the instantaneous phase angle relationship between the spur gear 128 and the shaft 116 is caused to vary as angular displacement of the vane 144 thus is accommodated, with an attendant change in the phase-angle relationship of the shafts 116 and 118.

In some instances, it becomes desirable to vary the phase-angle relationship between the shafts 116 and 118 while the engine SE is in its quiescent or inactive state. In order to effect such a change in the phase-angle relationship of these shafts, the housing 132 is provided with a further chamber, designated 180, FIG. 9. This chamber also includes a vane assembly, generally designated 182.

The chamber 180 and the vane assembly 182 are similar in design to the aforedescribed chamber 136 and vane assembly 140. Therefore, a detailed description of the vane assembly 182 is omitted in the interest of brevity. However, it is to be understood that the vane assembly 182 also includes a vane 184 rigidly affixed to the shaft 116, preferably in coplanar relation with the vane 144, which serves to divide the chamber 180 into a pair of subchambers, designated 186*a* and 186*b*. A pair of bores 188*a* and 188*b* extend through the wall of the housing 132 into a communicating relationship with the subchambers 186*a* and 186*b*. A conduit 100 serves to connect the bore 188*a* with a restrictor 102, similar to that previously described, while the conduit 104 serves to connect the bore 188*b* with the restrictor 106, also similar in design and function to the restrictor previously described. Consequently, under a no-load condition, for the controller, the phase-angle relation between the shafts 116 and 118 readily is varied simply by manipulating the phase control lever 78 in the manner similar to that hereinbefore described, for purposes of reversely pressurizing the subchambers 186*a* and 186*b* for thus imparting angular displacement to the vane 184, relative to the chamber 180, for thereby effecting angular displacement of the shaft 116 and a change in phase-angle relationship of the spur gear 128 with the shaft 116. As a consequence of this change, a change in the phase-angle relationship between the shafts 116 and 118 is effected.

OPERATION OF THE FIRST EMBODIMENT

With the actuator 30 connected to the carrier arm 28, in the manner hereinbefore described, the controller is prepared for operation simply by assuring that the chamber 82 for the master control cylinders 74 and 76 is substantially filled with a suitable hydraulic fluid, such as oil or the like. Similarly, the chambers 49*a* and 49*b* and 96*a* and 96*b* of the actuator 30 are substantially filled with hydraulic fluids. The various conduits are "bled" in a manner and for a purpose well understood by those familiar with the design and operation of hydraulic systems.

Assuming that the gear 22 is being driven in a clockwise direction and the torque output and the torque requirements of the crankshafts 16 and 18, respectively, are increasing, a positive going torque condition is seen by the force transfer gear 26. Hence, reactive forces are applied to the carrier arm 28 in a direction such that the restraint link 38 is depressed or urged downwardly. However, no movement of the link is permitted since the check valve 66 and the pilot valve 68 serve to block passage of hydraulic fluid from the chamber 49*b*. Similarly, when a negative torque condition is seen by the force transfer gear 26, the reactive forces applied to the carrier arm 28 is in a direction such that pressure within the pressure chamber 49*a* is increased, as the arm 28 seeks to rise in response to the negative torque condition. Here again, the discharge of hydraulic fluid from the discharge chamber 49*a* is prevented by the check valve 70 and the pilot valve 64. Thus the link 38 remains in its stationary or static position as it is cyclically subjected to reactive forces resulting from both positive and negative torque conditions for each revolution of the crankshafts 16 and 18.

In the event a positive going phase-angle change between the crankshafts 16 and 18 is desired, when the engine SE is in operation, the phase control lever 78 is pivoted toward the master control cylinder 74 for causing hydraulic fluid under pressure to be applied to the pilot valve 64 for thus opening the pilot valve. As negative torque condition, graphically depicted in FIG. 6, is seen by the force transfer gear 26 a lifting force is applied to the carrier arm 28. This force attempts to lift the arm in pivotal disdainment. Since the pilot valve 64 is now open axial extension of the link 38 is accommodated. As axial extension for the link 38 is accommodated the arm 28 is pivoted upwardly with a resultant change in the phase angle between the shafts 16 and 18.

Similarly, by reversing the direction of pivotal displacement of the phase control lever 78 the pilot valve 68 is opened whereby hydraulic fluid is discharged from the pressure chamber 49*b* and pressures are therein relieved for permitting the link 38 to be depressed. Thus a phase-angle change in an opposite direction is accommodated.

It will, of course, be appreciated that once a desired setting or phase-angle change has been effected the lever arm 78 is returned to a neutral position for thus assuring that pilot valves 64 and 68 remain closed, whereupon a stationary condition is imposed on the restraint link 38.

In instances where the engine SE is under a no-load condition, or in its quiescent or inoperative state, a phase-angle change between the shafts 16 and 18 is achieved simply by pivoting the phase control lever in a direction such that a pressure differential is established across the piston head 98, in response fluid is introduced into the chamber 96 for thus causing the restraint link 38 to move axially in a desired direction for elevating or depressing the carrier arm 28 in a selected direction, for thus causing the gear 24 to be angularly displaced in the selected direction for achieving a desired phase-angle relationship between the crankshafts 16 and 18. Once the desired phase-angle relationship is established the lever arm 78 is returned to its neutral position, whereupon the restraint link 38 is again stabilized against displacement in response to reactive forces applied to the carrier arm 28.

OPERATION OF THE FURTHER PREFERRED EMBODIMENT

With the actuator 120 assembled in the manner hereinbefore described, the controller 120 is prepared for operation simply by assuring that the chamber 82, for each of the master control cylinders 74 and 76, is substantially filled with a suitable hydraulic fluid, such as oil or the like. Similarly, the subchambers 136*a*, 136*b*, 186*a* and 186*b* of the actuator 130 are substantially filled with bodies of hydraulic fluid, introduced in any suitable manner. The various valves, chambers, conduits and the like are, of course, filled with fluid having entrapped air removed by conventional "bleeding" processes.

Assuming that the spur gear 128 is being driven in a clockwise direction and the torque output and torque requirements of the crankshafts 116 and 118 are increasing, a positive going torque condition is seen by the spur gears 122 and 128. Hence, an increasing reactive force is seen by the shaft 116. In order to achieve a change in the phase-angle relationship between the shafts 116 and 118, the phase control lever 78 is manipulated in a direction for causing the master control cylinder 74 to pressurize the conduit 92. In response to the pressurization of the conduit 92, the pilot valve 64 is opened permitting fluid of the body of fluid 150*a* to escape from the chamber 136*a* to the chamber 136*b* via the bore 152*a*, pilot valve 64, check valve 66, and thence to the chamber 136*b* via the bore 152. This exchange of fluid between the bodies of fluid 150*a* and 150*b* permits the vane 144 to rotate relative to the housing 132 and consequently permits the shaft 116 to rotate relative to the spur gear 128, whereupon a change in the phase-angle relationship between the shafts 116 and 118 is accommodated as a consequence of the change in the phase-angle relationship for the spur gear 128 and shaft 116.

A reverse change in the phase-angle is effected when the shaft 116 sees a negative torque, or a condition in which the spur gear 122 tends to over-run the spur gear 128, as a consequence of torque applied thereto via the shaft 118. In order to effect a change in the phase-angle relationship between the shafts 116 and 118, under such a condition, it is only necessary to manipulate the phase control lever 78 in a direction such that the master control cylinder 76 pressurizes the conduit 94 for opening the pilot valve 68 in order to permit an exchange of fluid between the chambers 136*a* and 136*b* to occur, via the pilot valve 68, check valve 70, the bores 152*a* and 152*b*, and conduits 62, 154 and 156. Displacement of the vane 144 within the chamber 136 thus is accommodated for achieving a change in the phase-angle relationship between the shafts 116 and 118, in a manner similar to that previously described with respect to changing of the phase-angle relationship in an opposite direction.

Further, should a no-load condition exist, and a phase-angle change is desired, it is simple necessary to manipulate the phase control lever 78 in an appropriate direction for alternately pressurizing the subchambers 186*a* and 186*b* for angularly displacing the vane 184 of the vane assembly 182 in an appropriate direction for thus angularly displacing the spur gear 128 relative to the shaft 116. It is to be understood that the manipulation of the phase control lever 78 serves to pressurize the subchambers 186*a* and 186*b* in a manner similar to that in which the aforedescribed chambers 96*a* and 96*b* of the chamber 96, hereinbefore described, are pressurized.

In view of the foregoing, it is believed to be readily apparent that the actuators embodying the principles of the instant invention are so configured as to operate as hydraulic ratchets fully utilizing variations in torque conditions between the expander and displacer portions of a Stirling engine, during each rotation of the crankshafts, so that a minimal external force is required to adjust the phase-angle relation between the crankshafts, within the engine, without power requirements of a magnitude long thought necessary to achieve the desired changes.

What is claimed is:

1. In combination with a phase-angle controller including an arcuately displaceable force transfer gear for controlling the phase-angle between a crankshaft, a second crankshaft and an actuator comprising:

A. a restraint link adapted to be connected with a force transfer gear for supporting the gear against arcuate displacement, whereby the link operatively is subjected to reversibly applied axial loads of varying magnitudes;

B. hydraulic means for supporting said link against displacement in response to axial loading including a piston head characterized by opposed faces mounted on the link, chamber means for receiving said piston head including means defining in communication with each of the faces a fluid-filled pressure chamber, each chamber having an instantaneous pressure dictated by the magnitude and direction of the axial load applied to said link; and C. means for releasing said link for axial displacement in response to axial loading thereof including a fluid conduit connecting the pressure chambers in fluid-exchanging communication, and an operable pilot valve connected in said conduit responsive to pressurized hydraulic fluid applied thereto for controlling fluid flow between the chambers.

2. The actuator of claim 1 wherein said pilot valve comprises an hydraulically actuated valve adapted to respond to increased fluid pressure applied thereto for establishing communication between said chambers, and said actuator further comprises means for operating said pilot valve including a master control cylinder having defined therein a fluid-filled chamber and an hydraulic piston seated in said chamber, means for connecting the fluid-filled chamber of said master control cylinder in direct communication with said pilot valve, and means for selectively displacing said piston for increasing the pressure within said fluid-filled chamber, whereby increased fluid pressure is applied to said pilot valve.

3. The actuator of claim 2 further comprising means for axially displacing said restraint link including another piston head having a pair of opposed faces connected to said link and seated in further chamber means having defined at each of the opposite faces of the other piston head a variable dimensioned pressure chamber, and conduit means for connecting at least one of the chambers to said master control cylinder.

4. The actuator of claim 2 wherein said hydraulic piston comprises a normally extended spring-loaded piston, and said master control cylinder further includes a reservoir continuously communicating with the fluid-filled chamber.

5. The actuator of claim 4 wherein said means for displacing said piston includes a manually operable pivotally supported phase control lever connected with said hydraulic piston and adapted to be displaced for displacing said piston.

6. In combination with a phase-angle controller having a pair of coaxially aligned bevel gears, one bevel gear of said pair being mounted on a variably torqued power output shaft for an expander portion of a Stirling engine, while the other bevel gear of the pair is mounted on a power input shaft, for a displacer portion of the Stirling engine, characterized by variable torque requirements, and a force transfer gear meshed with said pair of bevel gears, said force transfer gear being supported for reversible planetary travel by a carrier arm mounted at one end for pivotal displacement about an axis coincident with the axis of said pair of bevel gears in response to changes in reactive forces applied thereto as simultaneous changes in the torque output of said power output shaft and the torque requirements of said power input shaft occur, for thus changing the phase-angle between said shafts, phase-angle control means for selectively establishing a phase-angle between said power output shaft and said power input shaft, comprising:

A. a restraint link supported for rectilinear displacement and having one end thereof connected to said carrier arm in spaced relation with said one end of the carrier arms for restraining said force transfer gear from planetary travel; and B. hydraulic control means connected with said restraint link including a double-acting piston head rigidly affixed to said link, housing means supporting said piston head for reciprocating displacement, said piston head being so arranged as to establish within the housing means a pair of coaxially aligned, variably dimensioned pressure chambers, an hydraulic fluid substantially filling each of said pressure chambers, and selectively operable pressure release means connected with each of said chambers for relieving pressure developed therewithin for releasing said restraint link for displacement in response to reactive forces applied to the link through said arm.

7. Phase-angle control means as defined in claim 6 wherein said power output shaft comprises a crankshaft for an expander portion of a Stirling cycle engine and the power input shaft comprises a crankshaft for the displacer portion of the engine.

8. A control means as defined in claim 7 further comprising means connected with said motion restraint link for selectively imparting thereto axial displacement including another double-acting piston head connected to said link and seated in other housing means for establishing therein a further pair of coaxially aligned variably dimensioned pressure chambers, and means for varying the pressure across said other piston head.

9. In combination with a phase-angle controller for a Stirling engine, characterized by a pair of coaxially aligned bevel gears, one bevel gear of said pair being mounted on a crankshaft for an expander portion of the engine and the other bevel gear of said pair being mounted on a crankshaft for a displacer portion of the engine, and a third bevel gear comprising a force transfer gear meshed with said pair of gears in force transfer relation therewith, said force transfer gear being supported for reversible planetary travel by a carrier arm mounted at one end and supported for pivotal displacement about an axis coincident with the axis of said pair of bevel gears in response to changes in reactive forces applied thereto as changes simultaneously occur in the torque output of said crankshaft for the expander portion of the engine and the torque requirements of said crankshaft for the displacer portion of the engine, for thus changing the phase-angle between the crankshafts, an actuator comprising:

A. an axially displaceable link angularly related to said arm and connected thereto for restraining said force transfer gear from planetary travel as changing reactive forces are applied to said arm;

B. hydraulic control means connected with said restraint link including, a first double-acting piston head rigidly affixed to said link, said first head being characterized by a pair of opposed faces, means defining in communication with the faces of the first head a first pair of coaxially aligned hydraulic fluid-filled pressure chambers, at least two conduits interconnecting said pair of chambers, a pair of pilot valves, each being connected within one conduit and characterized by means responsive to applied hydraulic fluid under pressure for opening the valve for facilitating a flow of hydraulic fluid between said pressure chambers, a pair of one way check valves connected in said two conduits, said check valves being reversely oriented in said two conduits so as to limit fluid flow to flow through the conduits in opposite directions relative to said chambers, means for actuating said pilot valves including a pair of adjacently related master control cylinders, each being connected to one pilot valve of said pair and selectively operable for applying thereto hydraulic fluid under pressure, whereby a flow of hydraulic fluid between said pair of pressure chambers is facilitated for accommodating axial displacement of said link; and C. means for initiating motion of at least one of said crankshafts including a second double-acting piston head rigidly affixed to said link in coaxial alignment with said first piston head, said second piston head being characterized by a pair of opposed faces, means defining in communication with the pair of faces of said second piston head a second pair of coaxially aligned hydraulic fluid-filled pressure chambers, and means including a conduit having a fluid resistor connected therein for connecting each chambers of said second pair of pressure chambers to one master control cylinder to said pair, and means for actuating said master control cylinders simultaneously for transferring hydraulic fluid from one master control cylinder of said pair to one chamber of said second pair of pressure chambers, and transferring hydraulic fluid simultaneously to the other master control cylinder of said pair from the other pressure chamber of said second pair of pressure chambers for axially displacing said link.

10. The actuator of claim 9 wherein each of said master control cylinders includes a chamber, a hydraulic fluid reservoir connected in communication with the chambers, a piston seated in said chamber having an actuator shaft axially extended from the chamber, a helical spring seated in said chamber for continuously urging the actuator shaft in axial extension from the chamber, said master control cylinder being so related that the actuator shafts of said pair of master control cylinders are juxtaposed in coaxial alignment, and a pivoted phase control lever interposed between adjacent ends of the actuator shafts of said pair of master control cylinders.

11. In combination with a phase-angle controller for a Stirling engine characterized by a variably torqued power output shaft projected from a displacer portion of the engine and a power input shaft projected from an expander portion of the engine in parallelism with said power output shaft, a first gear mounted on said power input shaft in fixed relation therewith and a second gear mounted for free rotation on said power output shaft and meshed with said first gear, an actuator including:

means for varying the phase-angle relation between said power output shaft and said power input shaft, including an hydraulic coupler for releasably coupling said second gear to said power output shaft.

12. An actuator as defined in claim 11 wherein said hydraulic coupler includes:

A. a housing of a substantially cylindrical configuration rigidly affixed to said second gear and projected coaxially therefrom having defined therein a chamber;

B. means including a vane rigidly affixed to the output shaft and extended radially into said chamber dividing said chamber into a pair of subchambers, and a body of fluid substantially filling each of said subchambers; and C. fluid transfer means connected with said subchambers for selectively transferring fluid between the bodies of fluid filling the subchambers.

13. An actuator as defined in claim 12 wherein said fluid transfer means comprises a pilot valve and circuit means interconnecting said subchambers through said pilot valve, and valve control means connected to said pilot valve for selectively actuating said pilot valve for thereby interconnecting said bodies of fluid in communicating relation.

14. An actuator as defined in claim 12 wherein said power output shaft normally is restrained against rotation relative to said housing by a body of fluid and is released from restraint in response to said selective actuation of said pilot valve.

15. An actuator as defined in claim 13 wherein said valve control means includes a fluid-filled master control cylinder connected in communication with said valve means.

16. A phase-angle controller as defined in claim 15 wherein said actuator comprises one of a pair of actuators connected in combination with said phase-angle controller for varying the phase-angle relation between said power output shaft and said power input shaft.

17. The actuator of claim 15 further comprising means for displacing said vane including a further chamber defined in said housing, a further vane mounted on said output shaft and extended into said further chamber dividing said further chamber into a further pair of further subchambers, further bodies of fluid substantially filling each of said further subchambers, and conduit means connecting at least one of said further subchambers with said fluid-filled master control cylinder.

18. In combination with a phase-angle controller for a Stirling engine characterized by an expander drive output shaft having a first spur gear mounted for free rotation thereon and a displacer drive input shaft extended in side-by-side parallelism with said output shaft and having a second spur gear mounted thereof in fixed relation therewith, said first and second spur gears being intermeshed in a force transfer relationship, an actuator comprising:

A. a housing of a substantially cylindrical configuration rigidly affixed to said first spur gear and projected coaxially therefrom having defined therein a chamber arranged in juxtaposition with a portion of said output shaft;

B. means defining a vane rigidly affixed to the output shaft and projected radially therefrom into said chamber dividing said chamber into a pair of subchambers disposed in juxtaposition with said output shaft;

C. a body of fluid substantially filling each of said subchambers;

D. fluid transfer means interconnecting said subchambers in a fluid-exchanging relationship including a first and a second conduit connected therewith, a first and a second valve, each of said valves being characterized by an inlet side connected with one subchamber of said pair of subchambers and an outlet side connected with the other subchamber of said pair, and selectively operable valving means for establishing a fluid flow path between the inlet and outlet sides thereof; and E. valve operating means connected with the valving means of said first and second valves for selectively operating the valving means of each of the valves including a pair of master cylinders and hydraulic circuit means interconnecting one master cylinder of the pair of master cylinders with each of said valves.

19. An actuator as defined in claim 18 wherein the output shaft of the Stirling engine comprises a normally loaded output shaft, and said actuator includes means for angularly displacing said shaft under a no-load condition comprising:

A. a further chamber defined in said housing in juxtaposition with said output shaft;

B. a further vane dividing said further chamber into a pair of further subchambers;

C. further bodies of fluid substantially filling each subchamber of said pair of further subchambers; and D. further fluid transfer means including a pair of conduits connecting each of said further subchambers to one master cylinder of the pair of master cylinders.

* * * * *